US007581808B2

(12) United States Patent
Ishizawa et al.

(10) Patent No.: US 7,581,808 B2
(45) Date of Patent: Sep. 1, 2009

(54) LIQUID CONTAINER

(75) Inventors: Taku Ishizawa, Shiojiri (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 236 days.

(21) Appl. No.: 11/837,280

(22) Filed: Aug. 10, 2007

(65) Prior Publication Data

US 2008/0049079 A1 Feb. 28, 2008

(30) Foreign Application Priority Data

Aug. 12, 2006 (JP) ..... 2006-220765

(51) Int. Cl.
*B41J 29/393* (2006.01)

(52) U.S. Cl. ..... 347/19; 347/85

(58) Field of Classification Search ..... 347/19, 347/84–86, 67–71

See application file for complete search history.

(56) References Cited

U.S. PATENT DOCUMENTS

| | | | | |
|---|---|---|---|---|
| 6,336,709 | B1 * | 1/2002 | Inoue et al. | 347/49 |
| 7,121,656 | B2 | 10/2006 | Hattori | |
| 7,195,330 | B2 * | 3/2007 | Seino et al. | 347/19 |
| 2005/0243110 | A1 | 11/2005 | Takahashi et al. | |
| 2006/0007259 | A1 | 1/2006 | Zhang | |
| 2006/0152539 | A1 | 7/2006 | Zhang et al. | |

FOREIGN PATENT DOCUMENTS

| | | |
|---|---|---|
| JP | 2000-033709 A | 2/2000 |
| JP | 2001-146019 A | 5/2001 |
| JP | 2005-067076 A | 3/2005 |
| JP | 2006-194862 A | 7/2006 |

* cited by examiner

*Primary Examiner*—Lamson D Nguyen
(74) *Attorney, Agent, or Firm*—Sughrue Mion, PLLC

(57) ABSTRACT

The invention provides a liquid container having a container body that can be detachably attached to a liquid consumption apparatus, where the container body of the liquid container includes: a liquid containing chamber that retains liquid; a liquid supply hole that is provided to supply the liquid retained in the liquid containing chamber to the liquid consumption apparatus; a liquid flow channel through which the liquid containing chamber is in communication with the liquid supply hole; a liquid remaining amount detection sensor having a cavity that constitutes a part of the liquid flow channel, a diaphragm that constitutes a part of a wall surface of the cavity, and a piezoelectric element that applies a vibration to the diaphragm, the liquid remaining amount detection sensor detecting the presence or absence of liquid in the liquid flow channel on the basis of residual vibration in response to the vibration applied to the diaphragm; and a no-liquid-filled empty chamber that is in communication with the outside of the container body, the empty chamber with no liquid filled therein becoming a deaeration chamber that contains and/or accumulates negative pressure for deaeration when the liquid container is subjected to vacuum packing.

7 Claims, 13 Drawing Sheets

LIQUID CONTAINER

BACKGROUND

1. Technical Field

The present invention relates to a liquid container that supplies liquid retained in a liquid container body thereof to a liquid consumption apparatus.

2. Related Art

An ink cartridge containing ink inside thereof and an ink-jet recording apparatus to which such an ink cartridge is attached as a removable unit is a well known example set of a liquid container and a liquid consumption apparatus.

Inside the container body thereof which is detachably attached to the cartridge attachment unit of an ink-jet recording apparatus, a known ink cartridge has as its typical configuration ink-containing chambers (i.e., rooms or compartments) in which ink is retained, an ink supply port that is provided to supply the ink retained in the ink-containing chambers to the ink-jet recording apparatus, and an ink flow channel through which the ink-containing chambers communicate with the ink supply port. Such a known ink cartridge is configured to supply ink retained therein to the ink-jet recording apparatus through an ink supply needle that is provided on the cartridge attachment unit of the ink-jet recording apparatus when the ink cartridge is attached to the cartridge attachment unit thereof in such a manner that the ink supply needle of the cartridge attachment unit is inserted through the ink supply port of the ink cartridge.

Generally speaking, air bubbles often form in ink retained in an ink cartridge due to a temperature change during long-term storage, vibrations generated during shipping, or some other reason. These air bubbles deteriorate the ink-supply characteristics of the affected ink cartridge that is attached to an ink-jet recording apparatus, which could result in poor print quality. In order to suppress the forming of air bubbles inside an ink cartridge, as a known technique, an ink cartridge is vacuum packed immediately after its production so as to seal the periphery of the container body thereof as a pressure-reduced space. As a further technical insurance for prolonged storage, JP-A-2000-33709 proposes a technique to prolong the efficacy of reduced pressure in a vacuum-packed ink cartridge for a long time. Specifically, it is described in the above-identified publication that a concave portion, which is formed in the outer surface of the top cover of the container body of an ink cartridge that has ink-containing chambers, is utilized as a deaeration chamber, that is, a space into which any remaining air can be expelled, which contains/accumulates negative pressure for deaeration when the ink cartridge is subjected to vacuum packing.

In order to prevent the recording head of an ink-jet recording apparatus from performing "empty-cartridge printing" after the attached ink cartridge has run out of ink retained therein, some of ink-jet recording apparatuses have an ink remaining amount detection sensor that outputs a predetermined electric signal when the remaining amount of ink retained in the container body thereof reaches a certain predefined threshold. As described in JP-A-2001-146019, some of recently developed ink cartridges are provided with such an ink remaining amount detection sensor that is made up of a cavity that forms a part of an ink flow channel, a diaphragm that constitutes a part of the wall surface of the cavity, and a piezoelectric element that is provided on the diaphragm. In this type of recent ink cartridge, the remaining amount of ink is detected on the basis of a change in residual vibration in response to a vibration applied to the diaphragm.

Very small air bubbles could sometimes form (and remain) when, for example, ink is filled at a factory in the ink-containing chambers inside the container body during a production process of an ink cartridge. Disadvantageously, in an ink cartridge of related art that is provided with an ink remaining amount detection sensor, there is no way to remove air bubbles that formed at the time of filling of ink. Therefore, the air bubbles could remain in the cavity of the ink remaining amount detection sensor. If any air bubbles remain, there is a possibility that an erroneous detection of an ink-absent state could occur although there is still a sufficient amount of ink left inside at the time of starting the use of the ink cartridge. This erroneous detection occurs because the remaining air bubbles affect residual vibration.

SUMMARY

In order to address the problems described above without any limitation thereto, the present invention provides a liquid container that is provided with a liquid remaining amount detection sensor that detects the presence/absence of the liquid retained in the container body of the liquid container by utilizing residual vibration, where the liquid container according to the invention is capable of removing air bubbles if they formed during a liquid-filling production step at a factory and remain in the cavity of the liquid remaining amount detection sensor, thereby making it possible to prevent the liquid remaining amount detection sensor from performing erroneous detection attributable to the remaining air bubbles.

The invention provides a solution to the above-described problems without any limitation thereto by providing (1) a liquid container having a container body that can be detachably attached to a liquid consumption apparatus, where the container body of the liquid container includes: a liquid containing chamber that retains liquid; a liquid supply hole that is provided to supply the liquid retained in the liquid containing chamber to the liquid consumption apparatus; a liquid flow channel through which the liquid containing chamber is in communication with the liquid supply hole; a liquid remaining amount detection sensor having a cavity that constitutes a part of the liquid flow channel, a diaphragm that constitutes a part of a wall surface of the cavity, and a piezoelectric element that applies a vibration to the diaphragm, the liquid remaining amount detection sensor detecting the presence or absence of liquid in the liquid flow channel on the basis of residual vibration in response to the vibration applied to the diaphragm; and a no-liquid-filled empty chamber that is in communication with the outside of the container body, the empty chamber with no liquid filled therein becoming a deaeration chamber that contains and/or accumulates negative pressure for deaeration when the liquid container is subjected to vacuum packing.

With the configuration described above, even in a case where small air bubbles has formed in the cavity of the liquid remaining amount detection sensor during an ink-filling step of liquid-container production at a factory, such small air bubbles remaining in the cavity of the liquid remaining amount detection sensor dissolve into liquid and thus disappear thanks to the action of deaeration negative pressure that expels any remaining air out of the liquid container when the liquid container is subjected to vacuum packing. Moreover, deaeration negative pressure applied at the time of vacuum packing is contained/accumulated in the no-liquid-filled chamber (i.e., empty chamber) in such a manner that the no-liquid-filled chamber of the container body functions as a pressure reduction space that causes any air bubbles remaining in the container body to be dissolved to disappear effectively up to the time when a user opens the package of the liquid container. Therefore, the invention provides the liquid container that is capable of removing air bubbles that remain in the liquid remaining amount detection sensor with a greater certainty, thereby making it possible to prevent the liquid remaining amount detection sensor from performing erroneous detection attributable to the remaining air bubbles.

(2) In the liquid container having the configuration described above, it is preferable that the empty chamber having no liquid filled therein has a dimension larger than the liquid containing chamber. With the configuration described in (2) above, a comparatively large amount of negative pressure for deaeration is contained/accumulated in the no-liquid-filled empty chamber. This makes it possible to maintain a liquid container contained in a vacuum-packed package in a good pressure-reduced environment until a user opens the package thereof, thereby making it possible to prolong the efficacy of reduced pressure in removing air bubbles in the vacuum-packed liquid container for a long time. Thus, the configuration of the liquid container according to the invention makes it possible to further improve the shelf life of a vacuum-packed liquid container.

(3) In the liquid container having the configuration described above, it is preferable that the empty chamber having no liquid filled therein is formed at a plurality of positions in the container body in a distributed layout. With the configuration described in (3) above, the pressure-reducing action of deaeration negative pressure that is contained/accumulated in the empty chamber having no liquid filled therein works at the plurality of positions in the container body. This ensures, advantageously, that the pressure-reducing action of deaeration negative pressure, which is effective for removing air bubbles, works in a wider area of the container body in a more uniform manner. In addition, such pressure-reducing action works multi-directionally (i.e., from a relatively large number of directions) on the position at which air bubbles have formed. For these reasons, it is possible to remove air bubbles with a greater efficiency.

(4) It is preferable that the liquid container having the configuration described above further includes: an air intake channel through which air that has been taken in from the outside flows to reach the liquid containing chamber in accordance with the consumption amount of the liquid retained in the liquid containing chamber; an air chamber that is formed by enlarging the dimension of a certain halfway point en route on the air intake channel; and a stopper (such as a film to be removed) that blocks, in a vacuum-packed state, the air intake channel at a relatively upstream position in comparison with the air chamber. With the configuration described in (4) above, when any liquid retained in the liquid containing chamber flows back through the air intake channel during use of the liquid container due to thermal expansion, external vibration, or any other reason, it is possible to prevent the back-flowed liquid from leaking out because the air chamber formed en route on the air intake channel functions as a liquid-trap space so as not to pass the back-flowed liquid therethrough. Since the stopper blocks the air intake channel in a vacuum-packed state, it is possible to ensure that liquid does not leak out of the air intake hole.

(5) In the liquid container having the configuration described above, it is preferable that the empty chamber having no liquid filled therein has a dimension larger than the air chamber. If such a configuration is adopted, generally speaking, a higher deaeration performance is required for removing air bubbles because the amount of air remaining in the container body increases by the dimension of the air chamber. In this respect, with the configuration described in (5) above, since the dimension of the empty chamber having no ink filled therein is configured to be larger than that of the air chamber, it is possible to easily maintain high deaeration performance. With an assured high deaeration performance, the invention makes it possible to remove air bubbles that remain in the liquid remaining amount detection sensor with a greater reliability.

(6) In the liquid container having the configuration described above, it is preferable that the empty chamber having no liquid filled therein is formed adjacent to the liquid containing chamber and the air chamber. With the configuration described in (6) above, it is possible to ensure a relatively large active area for deaeration action of negative pressure which works via a partition wall interposed between the empty chamber having no liquid filled therein and the liquid containing chamber formed adjacent thereto and also works via a partition wall interposed between the empty chamber having no liquid filled therein and the air chamber formed adjacent thereto. Having such a structure, the liquid container according to the invention makes it possible to improve the deaeration efficiency inside the container body so as to remove air bubbles that remain in the liquid remaining amount detection sensor with a greater reliability. Thus, the liquid container according to the invention makes it possible to prevent the liquid remaining amount detection sensor from performing erroneous detection that could be caused by the remaining air bubbles.

(7) In the liquid container having the configuration described above, it is preferable that the empty chamber having no liquid filled therein is formed adjacent to the liquid containing chamber that is formed in the proximity of the cavity of the liquid remaining amount detection sensor. With the configuration described in (7) above, the deaeration efficiency inside the cavity of the sensor is further increased. Therefore, the invention provides the liquid container that is capable of removing air bubbles that remain in the liquid remaining amount detection sensor with a greater certainty, thereby making it possible to prevent the liquid remaining amount detection sensor from performing erroneous detection attributable to the remaining air bubbles.

BRIEF DESCRIPTION OF THE DRAWINGS

The invention will be described with reference to the accompanying drawings, wherein like numbers reference like elements.

FIG. 10A is a simplified diagram that corresponds to FIG. 8, whereas

DESCRIPTION OF EXEMPLARY EMBODIMENTS

With reference to the accompanying drawings, preferred embodiments of a liquid container according to the present invention are explained in detail below. In the following exemplary embodiment of the invention, an ink cartridge, which is attachable to an ink-jet recording apparatus (printer), is taken as an example of various kinds of liquid containers. An ink-jet recording apparatus is taken as an example of various kinds of liquid ejection apparatuses in the following description.

Figure 1:
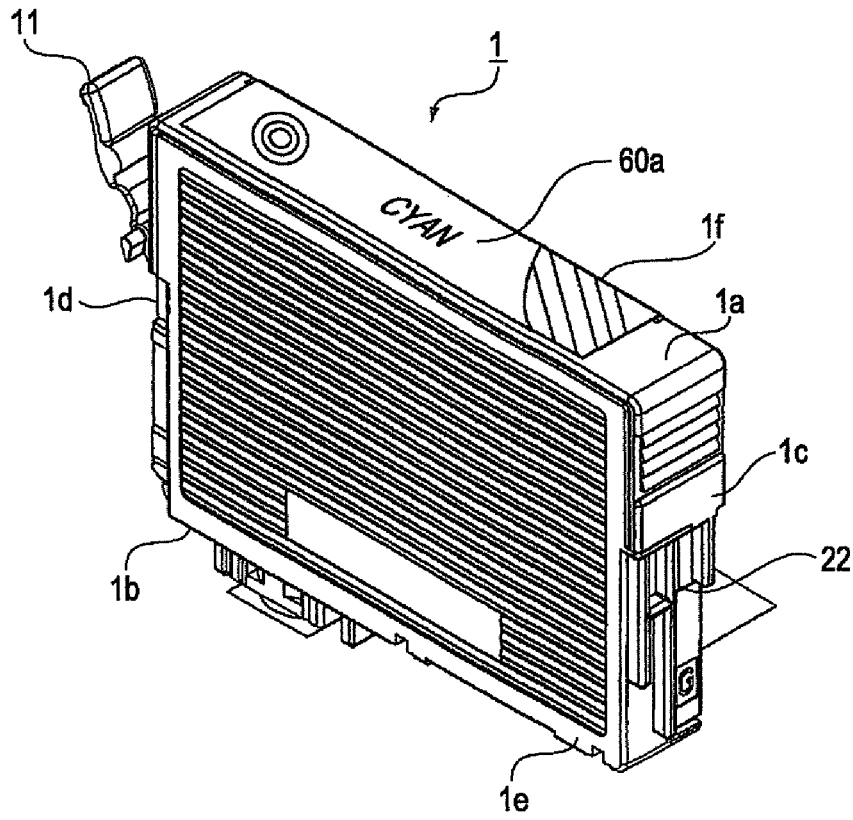
FIG. 1 is an external perspective view that schematically illustrates an ink cartridge as a first exemplary embodiment of the invention.
Figure 2:
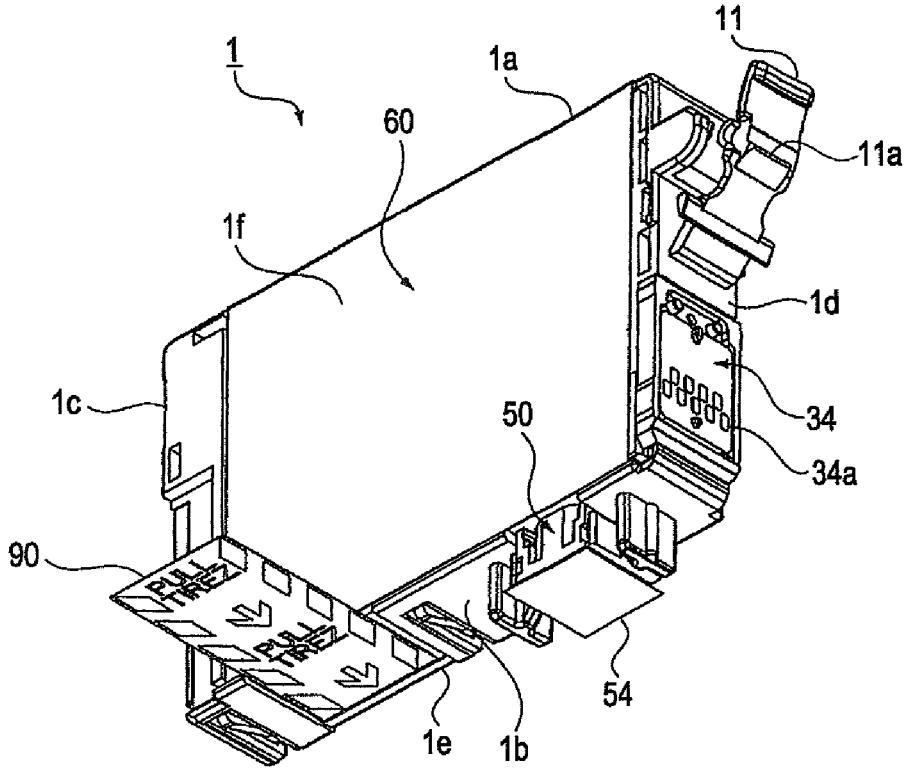
FIG. 2 is an opposite-side external perspective view that schematically illustrates the ink cartridge according to the first embodiment of the invention, which is viewed in the reverse direction thereof.
Figure 3:
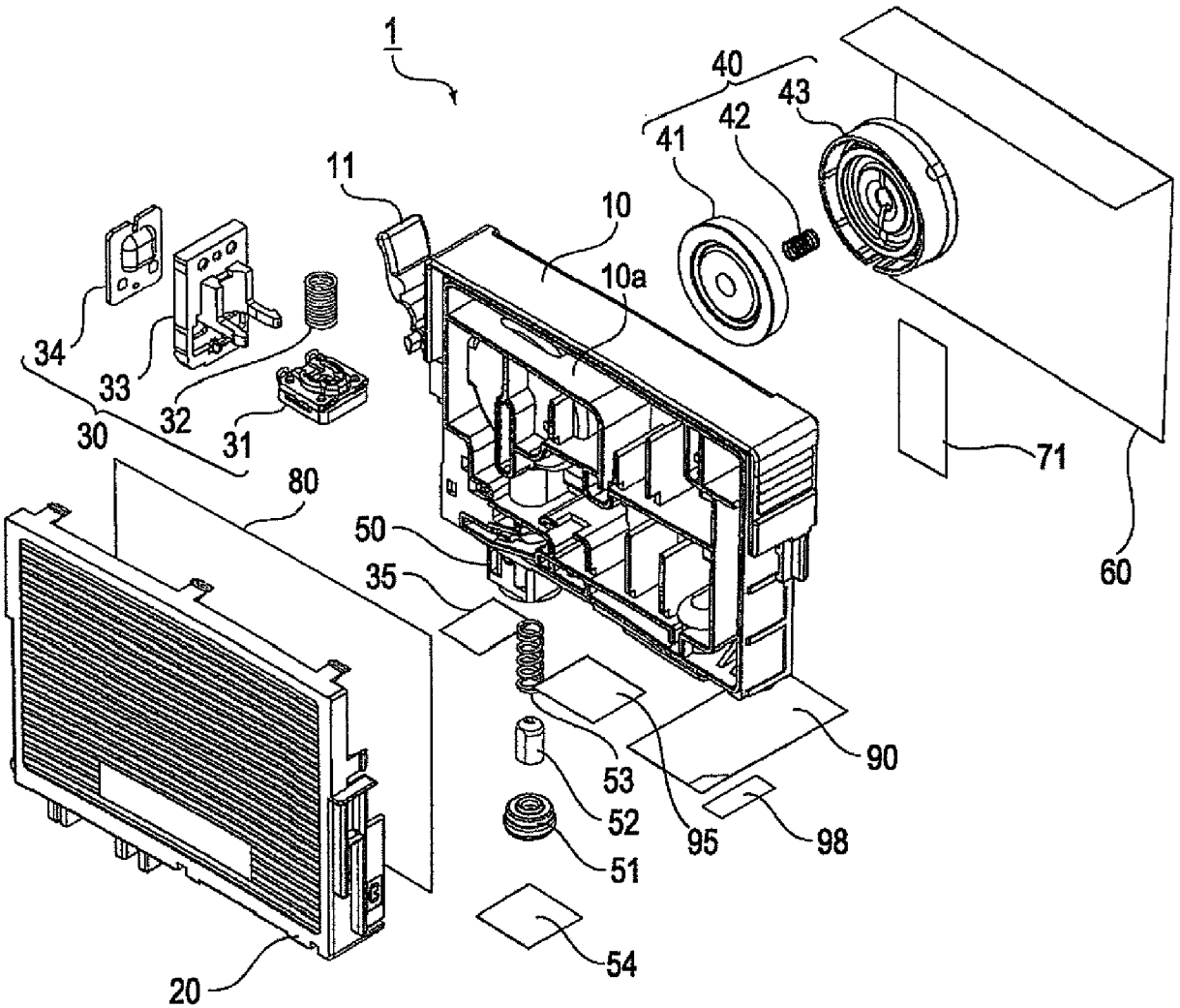
FIG. 3 is an exploded perspective view of the ink cartridge according to the first embodiment of the invention.
Figure 4:
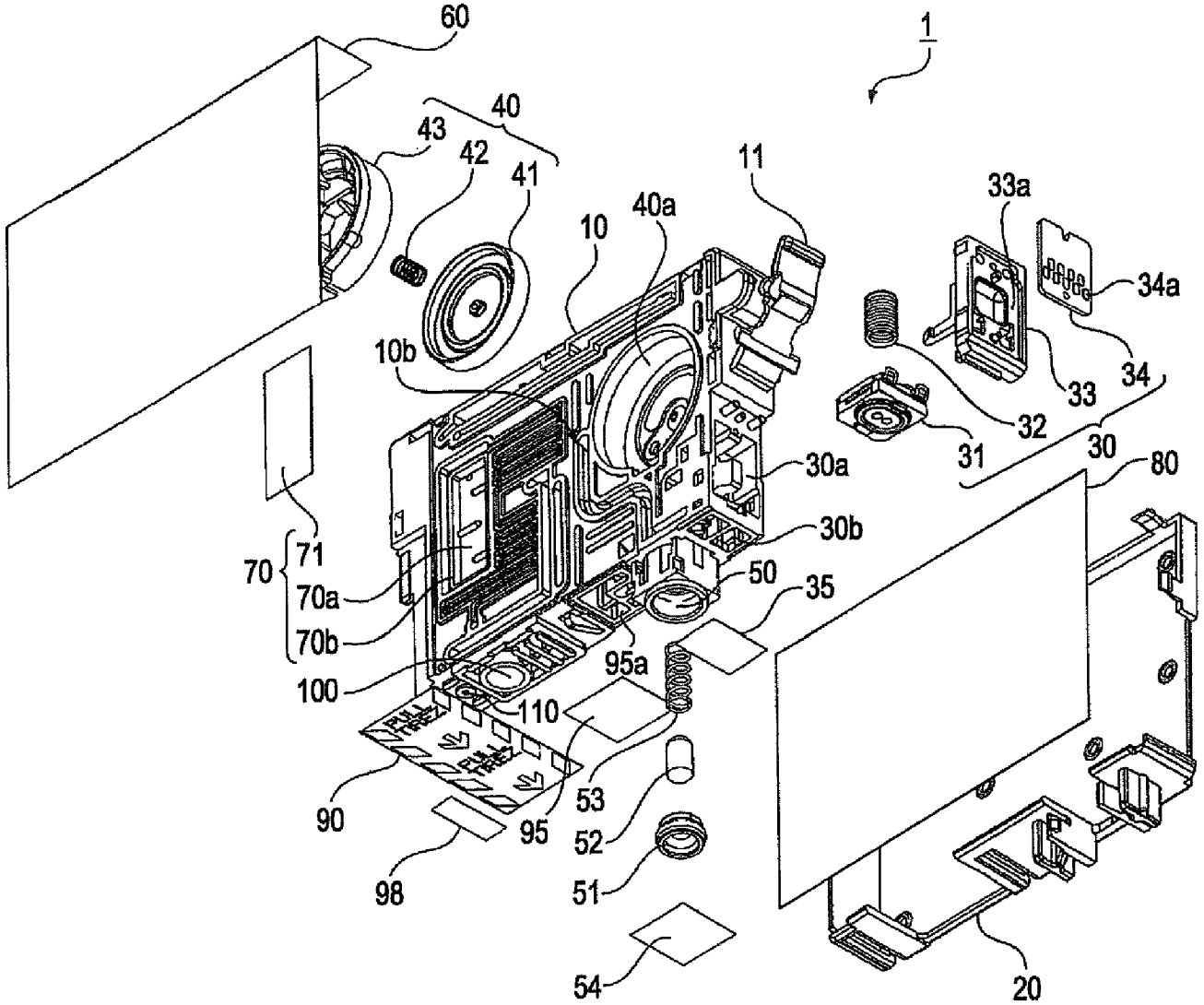
FIG. 4 is an opposite-side exploded perspective view of the ink cartridge according to the first embodiment of the invention, which is viewed in the reverse direction thereof.
Figure 5:
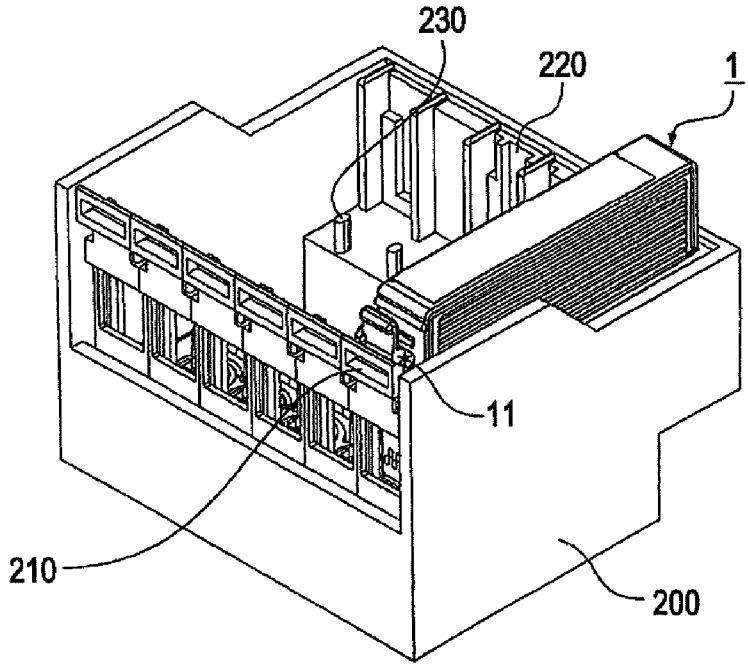
FIG. 5 is a diagram that schematically illustrates the ink cartridge according to the first embodiment of the invention that is attached to an ink-jet recording apparatus.
Figure 6:
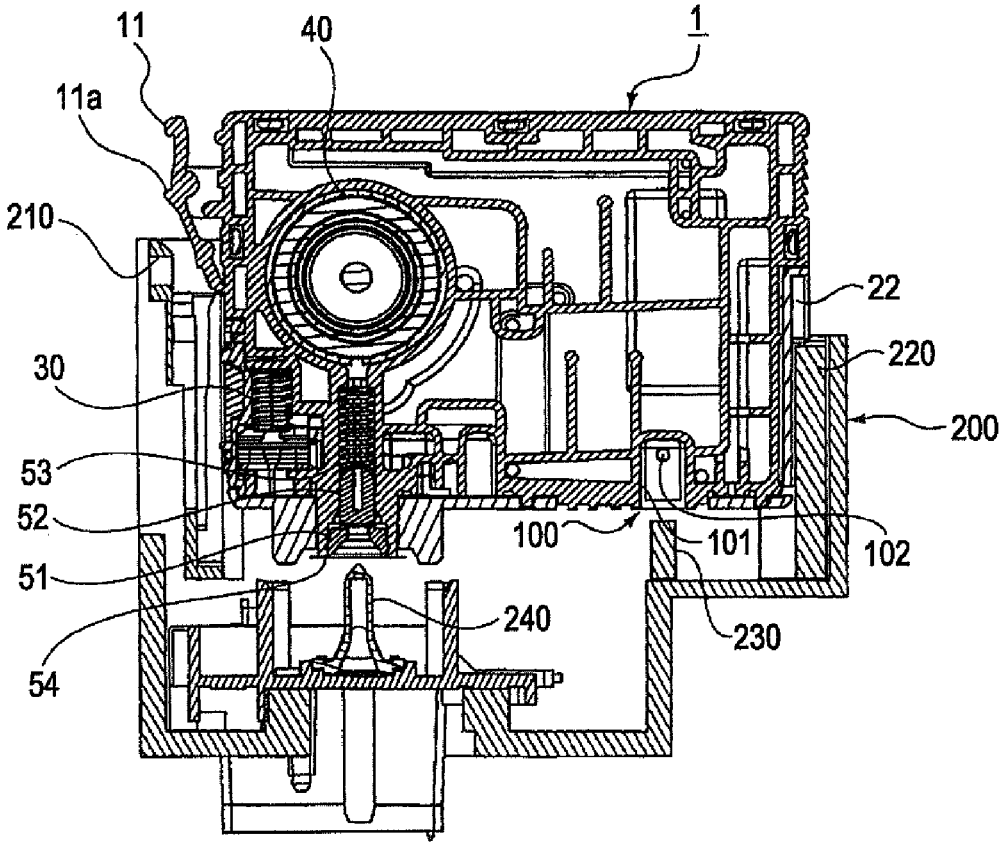
FIG. 6 is a sectional view of the ink cartridge according to the first embodiment of the invention that is viewed immediately before attachment to a carriage.
Figure 7:
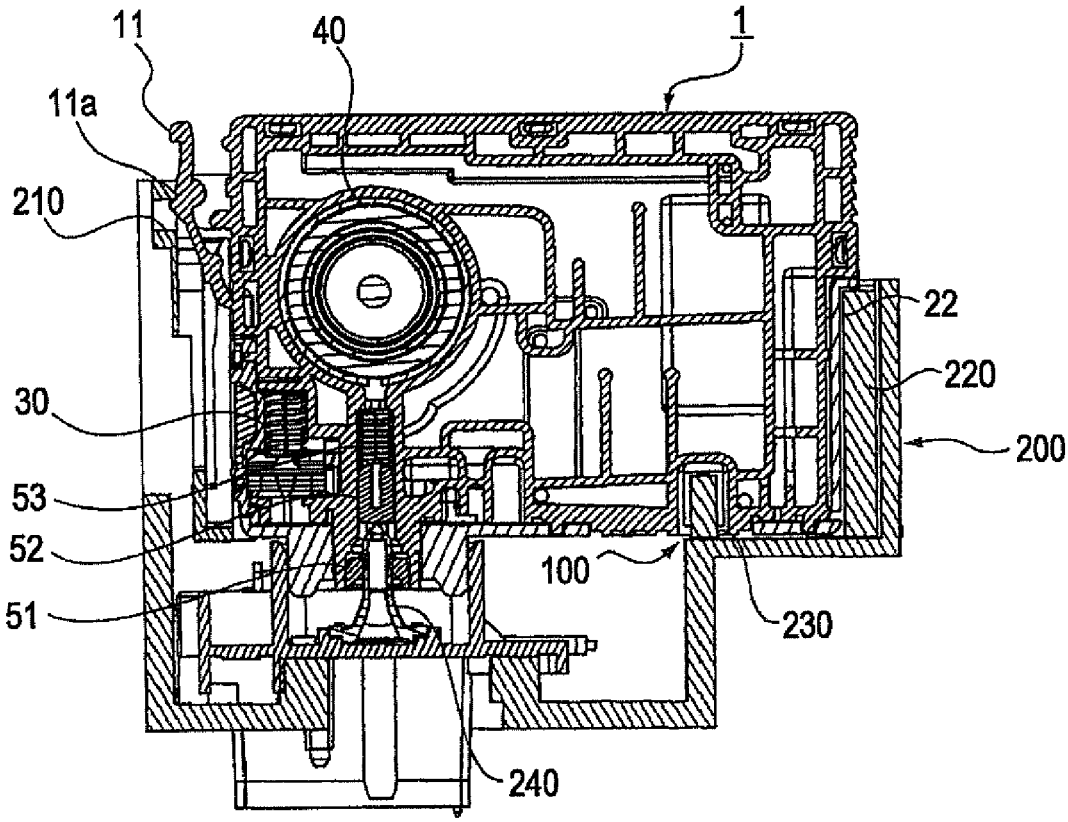
FIG. 7 is a sectional view of the ink cartridge according to the first embodiment of the invention that is viewed immediately after attachment to the carriage.

FIG. 1 is an external perspective view that schematically illustrates an ink cartridge as a first exemplary embodiment of a liquid container according to the present invention. FIG. 2 is an "opposite-side" external perspective view that schematically illustrates the ink cartridge according to the present embodiment of the invention, which is viewed in the reverse direction thereof. FIG. 3 is an exploded perspective view of the ink cartridge according to the present embodiment of the invention, whereas FIG. 4 is an opposite-side exploded perspective view of the ink cartridge according to the present embodiment of the invention, which is viewed in the reverse direction thereof. FIG. 5 is a diagram that schematically illustrates the ink cartridge according to the present embodiment of the invention that is attached to a carriage. FIG. 6 is a sectional view of the ink cartridge according to the present embodiment of the invention that is viewed immediately before attachment to the carriage. FIG. 7 is a sectional view of the ink cartridge according to the present embodiment of the invention that is viewed immediately after attachment to the carriage.

As illustrated in FIGS. 1 and 2, an ink cartridge 1 according to the present embodiment of the invention is a liquid container having the shape of, approximately, a rectangular parallelepiped. The ink cartridge 1 according to the present embodiment of the invention contains ink in ink-containing chambers provided inside thereof. As illustrated in FIG. 5, the ink cartridge 1 is attached to a carriage 200 of an ink-jet recording apparatus, which is explained herein as an example of various kinds of liquid consumption apparatuses. The ink cartridge 1 supplies ink to the ink-jet recording apparatus.

The external features of the ink cartridge 1 are described below. As illustrated in FIGS. 1 and 2, the ink cartridge 1 has a flat top surface 1*a*. An ink supply hole 50, which is used to supply ink to an ink-jet recording apparatus when the ink cartridge 1 is attached to the ink-jet recording apparatus, is provided on a bottom surface 1*b*, which is at the opposite side of the top surface 1*a*. As illustrated in FIG. 4, an air intake hole 100, which takes air from the outside into the ink cartridge 1, is formed on the bottom surface 1*b*. In other words, the ink cartridge 1 is configured as an air-open type ink cartridge that supplies ink through the ink supply hole 50 while taking in air through the air intake hole 100.

As illustrated in FIG. 6, in this embodiment of the invention, the air intake hole 100 has a concave portion 101 and a small hole 102. The concave portion 101 is an approximately cylindrical cavity that is formed in the bottom surface 1*b* in a direction toward the top surface 1*a*. The small hole 102 is formed in the inner circumference surface of the concave portion 101. The small hole 102 is in communication with an air intake channel/passage that will be described later. The outside air is taken in through the small hole 102 to finally reach the most upstream ink-containing chamber 370.

The concave portion 101 of the air intake hole 100 is formed to have a depth that is large enough to accommodate a projection 230 formed on the carriage 200. The projection 230 is provided to remind a user to remove a sealing film 90 if they forgot to do so. The sealing film 90 functions as a stopper that seals the air intake hole 100 in an airtight state. Since the projection 230 does not get inserted into the air intake hole 100 without removing the sealing film 90 in advance, it is impossible to attach the ink cartridge 1 to the carriage 200 if the sealing film 90 remains adhered thereto. By this means, since the projection structure makes it impossible for a user to attach the ink cartridge 1 to the carriage 200 if the sealing film 90 is still adhered to cover the air intake hole 100, it is ensured that a user is reminded to remove the sealing film 90 at the time of attachment of the ink cartridge 1 to the carriage 200.

As illustrated in FIG. 1, a "wrong-insertion-prevention" projection 22 is provided on the narrow side surface 1*c* of the ink cartridge 1, which is perpendicularly adjacent to the top surface 1*a* thereof across its one short edge. The wrong-insertion-prevention projection 22 prevents the ink cartridge 1 from being attached to any incorrect attachment position. As illustrated in FIG. 5, a patterned indented structure 220, which is configured to fit with the wrong-insertion-prevention projection 22 if they match, is provided on the carriage 200, which accommodates the ink cartridge 1. With such a mating structure, the ink cartridge 1 is successfully attached to the carriage 200 only when the wrong-insertion-prevention projection 22 fits with the patterned indented structure 220. Depending on the types of ink, the shapes of the wrong-insertion-prevention projection 22 vary from one to another. The patterned indented structure 220 formed on the carriage 200 has likewise shapes that vary from one to another depending on the types of ink. Therefore, even when the carriage 200 is configured such that a plurality of ink cartridges 1 are attachable to the carriage 200 as illustrated in FIG. 5, the attachment of any ink cartridge to a wrong attachment position does not occur.

As illustrated in FIG. 2, a latch-engaging lever 11 is provided on another narrow side face 1*d* of the ink cartridge 1, which is the opposite side of the narrow side surface 1*c* thereof. The latch-engaging lever 11 has a projection 11*a* that hooks on a concave portion 210 formed on the carriage 200 when the ink cartridge 1 is attached to the carriage 200. At the time of attachment of the ink cartridge 1 to the carriage 200, the latch-engaging lever gets temporarily deflected once so as to allow the engagement of the projection 11*a* with the concave portion 210. By this means, the position of the ink cartridge 1 is fixed with respect to the carriage 200.

A circuit substrate 34 is provided at an area below the latch-engaging lever 11. The circuit substrate 34 has a plurality of electric connection terminals 34*a* formed thereon. The ink cartridge 1 is electrically connected to an ink-jet recording apparatus when these electric connection terminals 34*a* mechanically/physically contact an electric connection member provided on the carriage 200, which is not specifically shown in the drawing. A data-rewritable non-volatile memory, which is not specifically shown in the drawings, is provided on the circuit substrate 34. Having such a non-volatile memory therein, various items of information on the ink cartridge 1 and/or ink use status information on the ink-jet recording apparatus, without any limitation thereto, is stored in the circuit substrate 34. As illustrated in FIGS. 3 and 4, an ink remaining amount detection sensor (sensor unit) 31 that detects the remaining amount of ink retained in the ink cartridge 1 by utilizing residual vibration is provided at the rear side of the circuit substrate 34. The ink remaining amount detection sensor 31 is a specific example of a liquid remaining amount detection sensor. In the following explanation, the ink remaining amount detection sensor 31 and the circuit substrate 34 are collectively referred to as ink end sensor 30.

As illustrated in FIG. 1, a label 60*a* that indicates the contents of an ink cartridge is pasted on the top surface 1*a* of the ink cartridge 1. The label 60*a* is constituted as an end portion of an outer surface film 60. Specifically, the outer surface film 60 covers a wide side surface 1*f* of the ink cartridge 1 to further extend onto the top surface 1*a* thereof, where the extended portion thereof overlying the top surface 1*a* constitutes the label 60*a*.

As illustrated in FIGS. 1 and 2, each of the wide side surfaces 1*e* and 1*f* of the ink cartridge 1 that are perpendicularly adjacent to the top surface 1*a* thereof across two long edges thereof is configured as a flat plane. In the following explanation, for convenience, the wide side surface 1*e* is referred to as the front face or front side of the ink cartridge 1, whereas the wide side surface 1*f* is referred to as the rear face or rear side thereof. In addition, the narrow side surface 1*c* is referred to as the right face or right side thereof, whereas the narrow side surface 1*d* is referred to as the left face or left side thereof.

Next, with reference to FIGS. 3 and 4, parts/components of the ink cartridge 1 are explained below.

The ink cartridge 1 includes a cartridge body 10, which is a container body, and a cover member 20 that covers the front face of the cartridge body 10.

The cartridge body 10 has ribs 10*a*, which have a variety of shapes, on the front face thereof. Functioning as inner-wall partitions, these ribs 10*a* demarcate the inner space at the front side of the cartridge body 10 into a plurality of ink-containing chambers (liquid-containing chambers/rooms) in which ink is retained, an empty chamber in which no ink is filled, air chambers which are formed at certain halfway points en route on an air intake channel/passage 150, which will be described later. A film 80 is provided between the cartridge body 10 and the cover member 20 to cover the front face of the cartridge body 10. Specifically, the film 80 covers the open top area of the ribs 10*a*, concave portions, and grooves so as to form the ink-containing chambers, empty chamber (i.e., no-ink-filled chamber), air chambers as well as a plurality of fluid channels (i.e., liquid/air flow channels).

A differential pressure regulation valve accommodating chamber 40*a*, which is a concave portion provided to accommodate a differential pressure regulation valve 40, and an air/liquid separation chamber 70*a*, which is a concave portion that constitutes a part of an air/liquid separation filter 70, are formed on the rear face of the cartridge body 10.

A valve member 41, a spring 42, and a spring washer structure 43 are assembled into the differential pressure regulation valve accommodating chamber 40*a* so as to make up the differential pressure regulation valve 40. The differential pressure regulation valve 40 is provided between the ink supply hole 50, which is provided at the downstream side thereof, and the ink-containing chamber, which is provided at the upstream side thereof. The differential pressure regulation valve 40 reduces the pressure of the downstream side thereof in comparison with the upstream side thereof so as to ensure that ink to be supplied to the ink supply hole 50 has negative pressure.

Figure 10A:
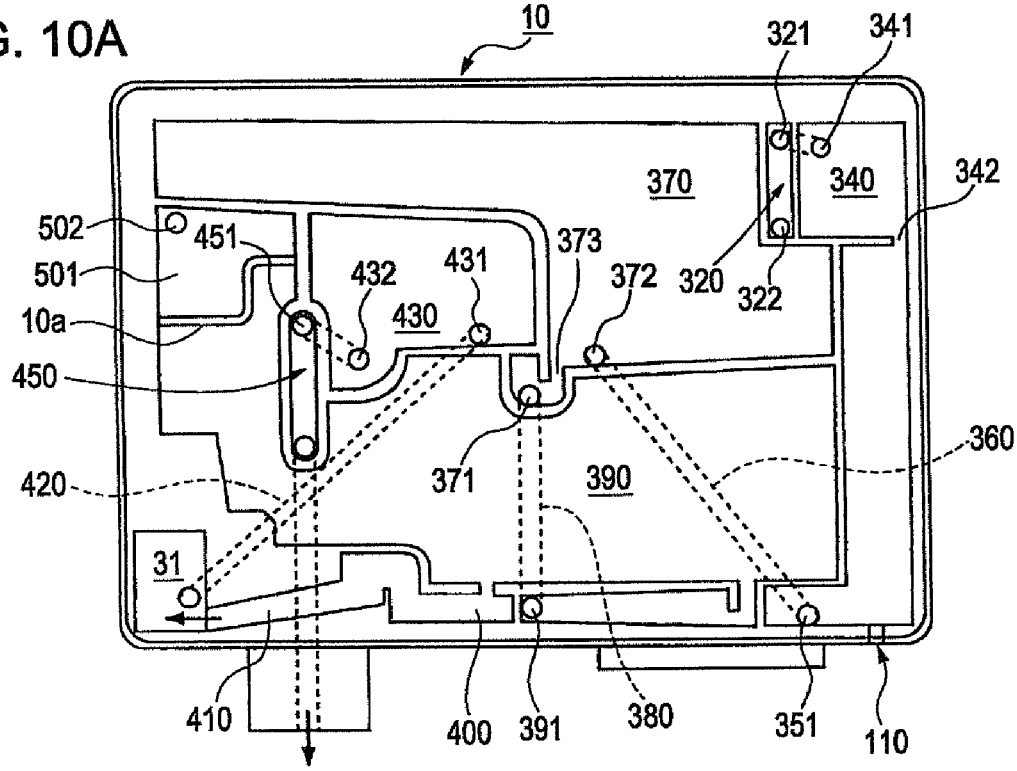
Figure 10B:
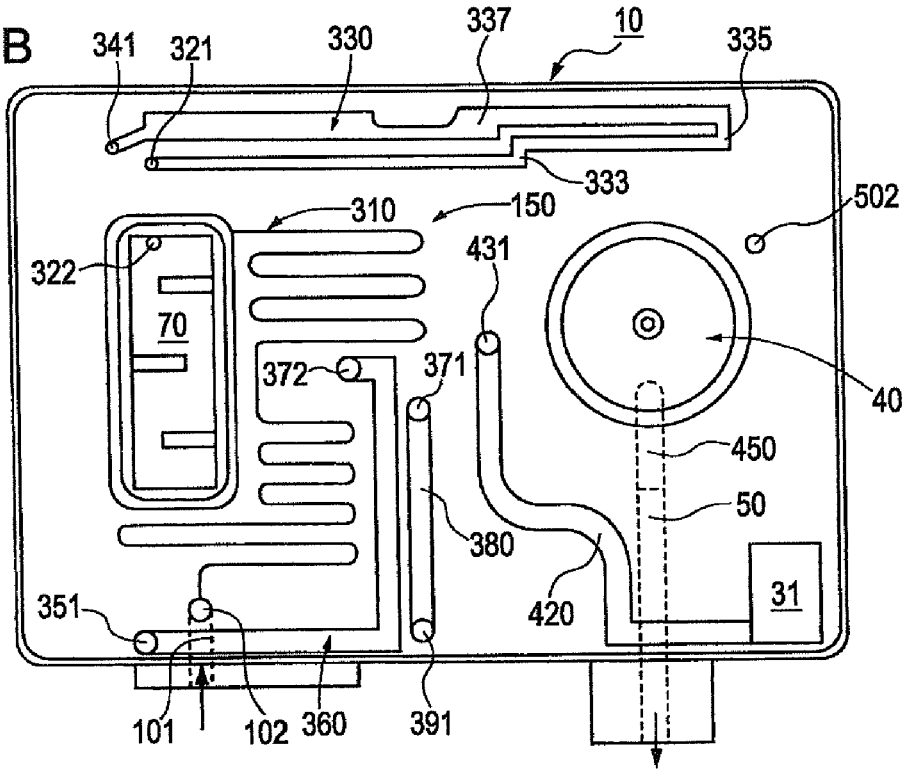
FIG. 10B is a simplified diagram that corresponds to FIG. 9.

An air/liquid separation film 71 is adhered to the bank portion 70*b* that forms the inner peripheral edge of the air/liquid separation chamber 70*a* so as to cover the open top area of the air/liquid separation chamber 70*a*. The air/liquid separation film 71, which constitutes a part of the air/liquid separation filter 70, is made of a material that passes air but shuts off liquid. As illustrated in FIG. 10B, the air/liquid separation filter 70 is provided en route on the air intake channel 150 through which the air intake hole 100 communicates with the ink-containing chambers. The air/liquid separation filter 70 functions to prevent any ink retained in the ink-containing chambers from flowing backward through the air intake channel 150 to flow out of the air intake hole 100.

In addition to the differential pressure regulation valve accommodating chamber 40*a* and the air/liquid separation chamber 70*a*, a plurality of grooves 10*b* are formed at the rear side of the cartridge body 10. The outer surface film 60 covers the entire open rear area of the cartridge body 10 to seal the differential pressure regulation valve 40 and the air/liquid separation filter 70 configured as described above as well as each of the exposed grooves 10*b*. The covered grooves constitute the air intake channel/passage 150 and ink flow channels.

As illustrated in FIG. 4, a sensor accommodating chamber 30*a* is formed on the right face of the cartridge body 10. The sensor accommodating chamber 30*a* is configured as a concave portion that accommodates parts that make up an ink end sensor 30. The ink remaining amount detection sensor 31, and a compression spring 32 that presses the ink remaining amount detection sensor 31 against the inner wall of the sensor accommodating chamber 30*a* for fixation thereof, are assembled into the sensor accommodating chamber 30*a*. A cover member 33 is then attached so to cover the sensor accommodating chamber 30*a*. A circuit substrate 34 is mounted on the outer surface 33*a* of the cover member 33. The sensor unit of the ink remaining amount detection sensor 31 is connected to the circuit substrate 34.

The ink remaining amount detection sensor 31 has a cavity that constitutes a part of the ink flow channel through which the ink-containing chambers communicate with the ink supply hole 50, a diaphragm that constitutes a part of the wall surface of the cavity, and a piezoelectric element (piezoelectric actuator) that applies a vibration to the diaphragm. The ink remaining amount detection sensor 31 detects the presence/absence of ink in the ink flow channel on the basis of residual vibration in response to the vibration applied to the diaphragm. That is, the ink remaining amount detection sensor 31 detects the presence/absence of ink in the cartridge body 10 on the basis of differences in the amplitude, frequency, or the like of residual vibration between ink and air. Specifically, when ink retained in the ink-containing chamber of the cartridge body 10 is consumed to cause air to be taken in the ink-containing chamber and then to flow through the ink flow channel to go into the cavity of the ink remaining amount detection sensor 31, the ink remaining amount detection sensor 31 detects the entering of air into its cavity on the basis of changes in the amplitude and/or frequency of residual vibration, and then outputs an electric signal that indicates an ink end.

As illustrated in FIG. 4, a pressure reduction hole 110, a concave portion 95*a*, and a buffer chamber 30*b* are provided on the bottom face of the cartridge body 10 in addition to the ink supply hole 50 and the air intake hole 100 that have already been described above. The pressure reduction hole 110 is used for reducing the inner pressure of the cartridge body 10. That is, air is sucked from the ink cartridge 1 through the pressure reduction hole 110 by using vacuuming means at the time of filling ink therein for inner pressure reduction. The concave portion 95*a* constitutes a part of the ink flow channel through which the ink-containing chambers communicate with the ink supply hole 50. The buffer chamber 30*b* is provided below the ink end sensor 30.

Immediately after production of an ink cartridge, the ink supply hole 50, the air intake hole 100, the pressure reduction hole 110, the concave portion 95*a*, and the buffer chamber 30*b* are sealed by sealing films 54, 90, 98, 95, and 35, respectively. The sealing film 90, which seals the air intake hole 100, is designed to be removed by a user before the ink cartridge is attached to an ink-jet recording apparatus for use thereof. The removal of the sealing film 90 makes the air intake hole 100 exposed to the outside so that the outside air can enter from the air intake hole 100 to flow through the air intake channel 150 and finally to reach the ink-containing chambers inside the ink cartridge 1.

As illustrated in FIGS. 6 and 7, an ink supply needle 240, which is provided on an ink-jet recording apparatus, is designed to pierce through the sealing film 54, which is adhered to the edge of the ink supply hole 50, when the ink cartridge 1 is attached to the ink-jet recording apparatus.

The inner structure of the ink supply hole 50 is made up of, as illustrated in FIGS. 6 and 7, a ring-shaped sealing member 51, a spring stopper structure 52, and a compression spring 53. The ring-shaped sealing member 51 is pressed against the outer surface of the ink supply needle 240 when the ink cartridge 1 is attached to the ink-jet recording apparatus. The spring stopper structure 52 "press-contacts" with the sealing member 51 when the ink cartridge 1 is not attached to the ink-jet recording apparatus so as to block up the ink supply hole 50. The compression spring 53 applies a pressing force to the spring stopper structure 52 toward the sealing member 51 for contact therebetween.

As understood from FIGS. 6 and 7, when the ink supply needle 240 is inserted into the ink supply hole 50, the inner circumference portion of the sealing member 51 contacts the outer circumference portion of the ink supply needle 240 so as to seal a gap between the ink supply hole 50 and the ink supply needle 240 in liquid-tight condition. In addition thereto, the tip of the ink supply needle 240 contacts the spring stopper structure 52 and pushes the spring stopper structure 52 up so as to unseal the liquid-tight contact between the spring stopper structure 52 and the sealing member 51. By this means, it becomes possible to supply ink from the ink supply hole 50 to the ink supply needle 240.

Next, with reference to FIGS. 8-12, the inner configuration of the ink cartridge 1 according to the present embodiment of the invention is explained below.

Figure 8:
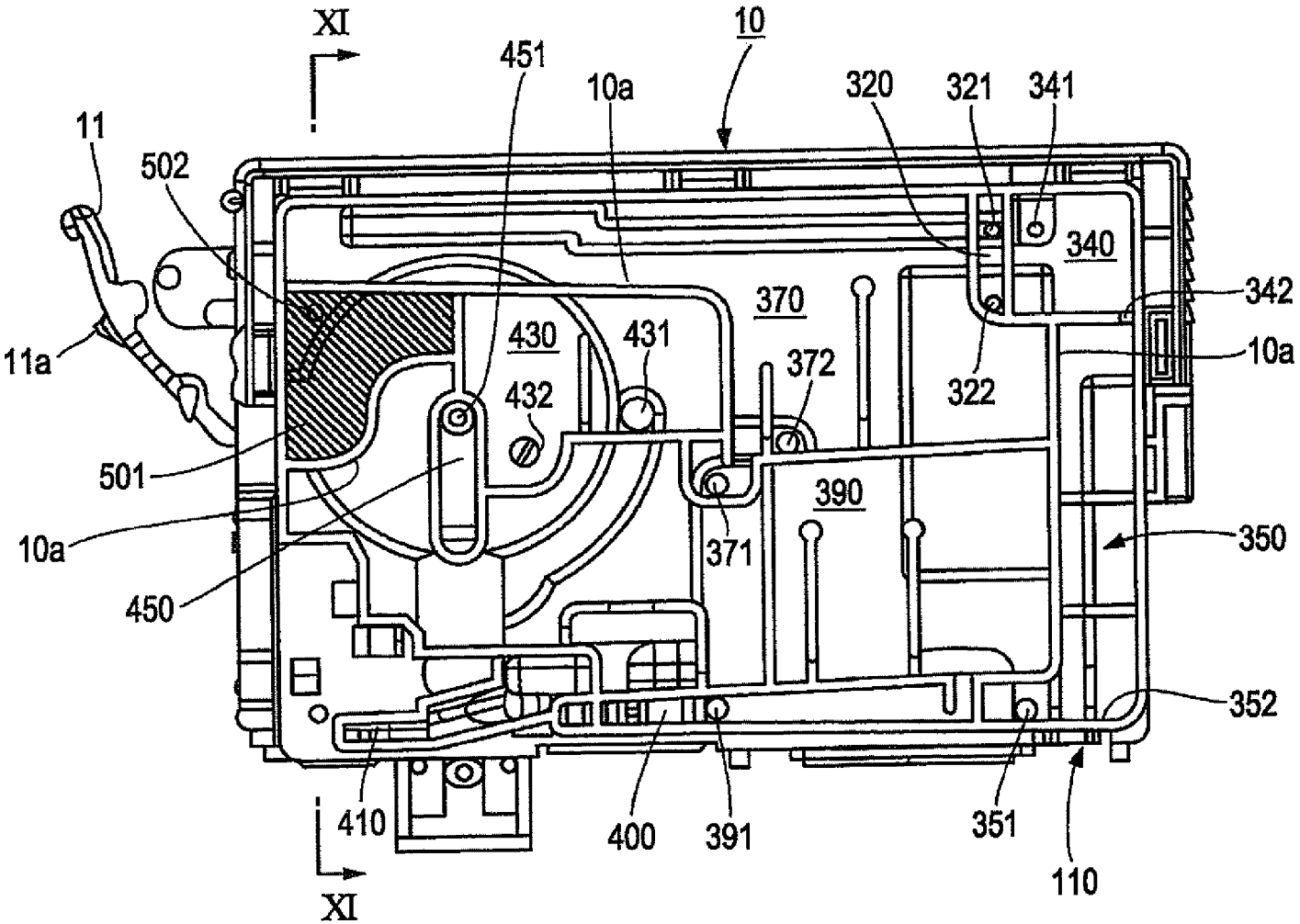
FIG. 8 is a front view of the ink cartridge according to the first embodiment of the invention.
Figure 9:
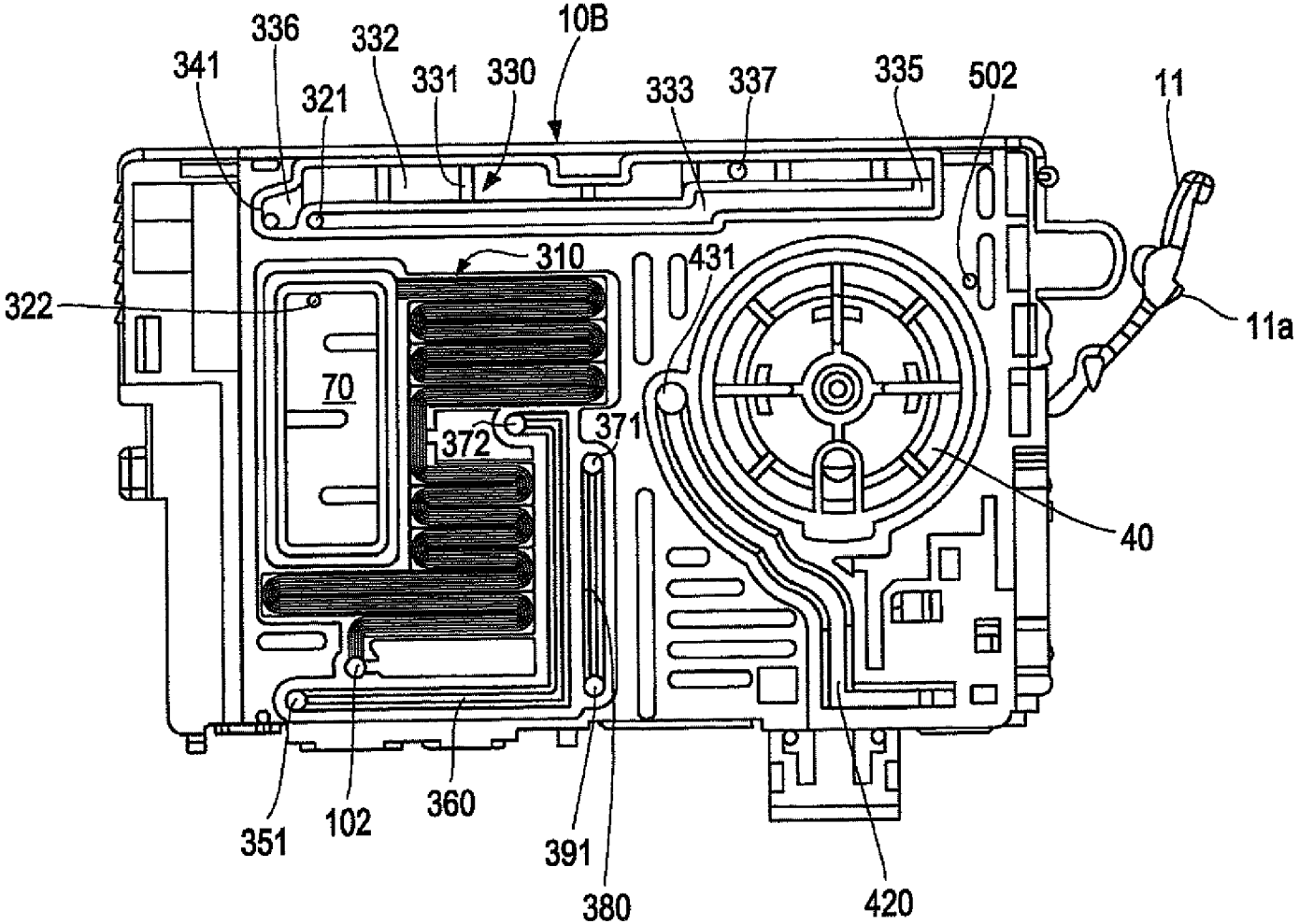
FIG. 9 is a rear view of the ink cartridge according to the first embodiment of the invention.
Figure 11:
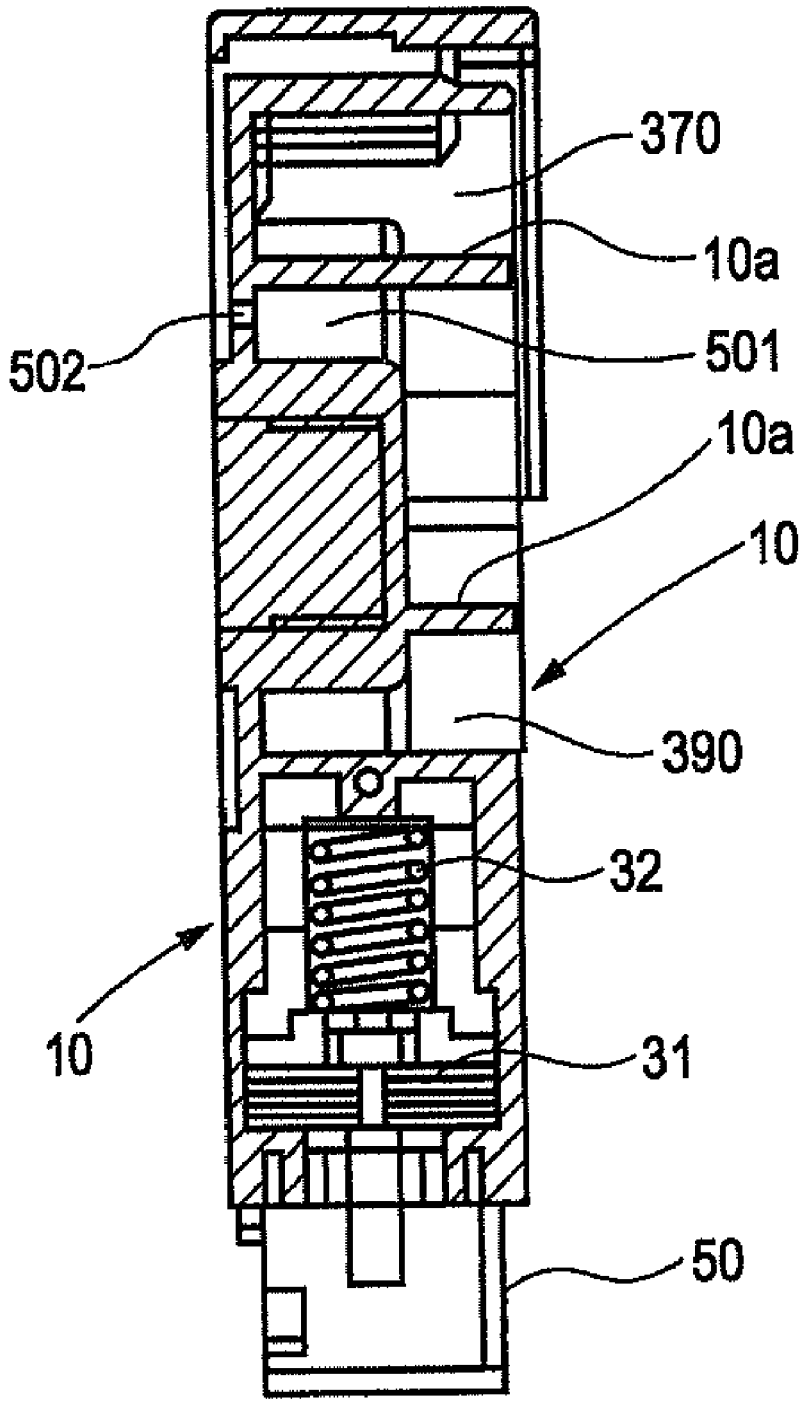
FIG. 11 is a sectional view taken along the line A-A' of FIG. 8.
Figure 12:
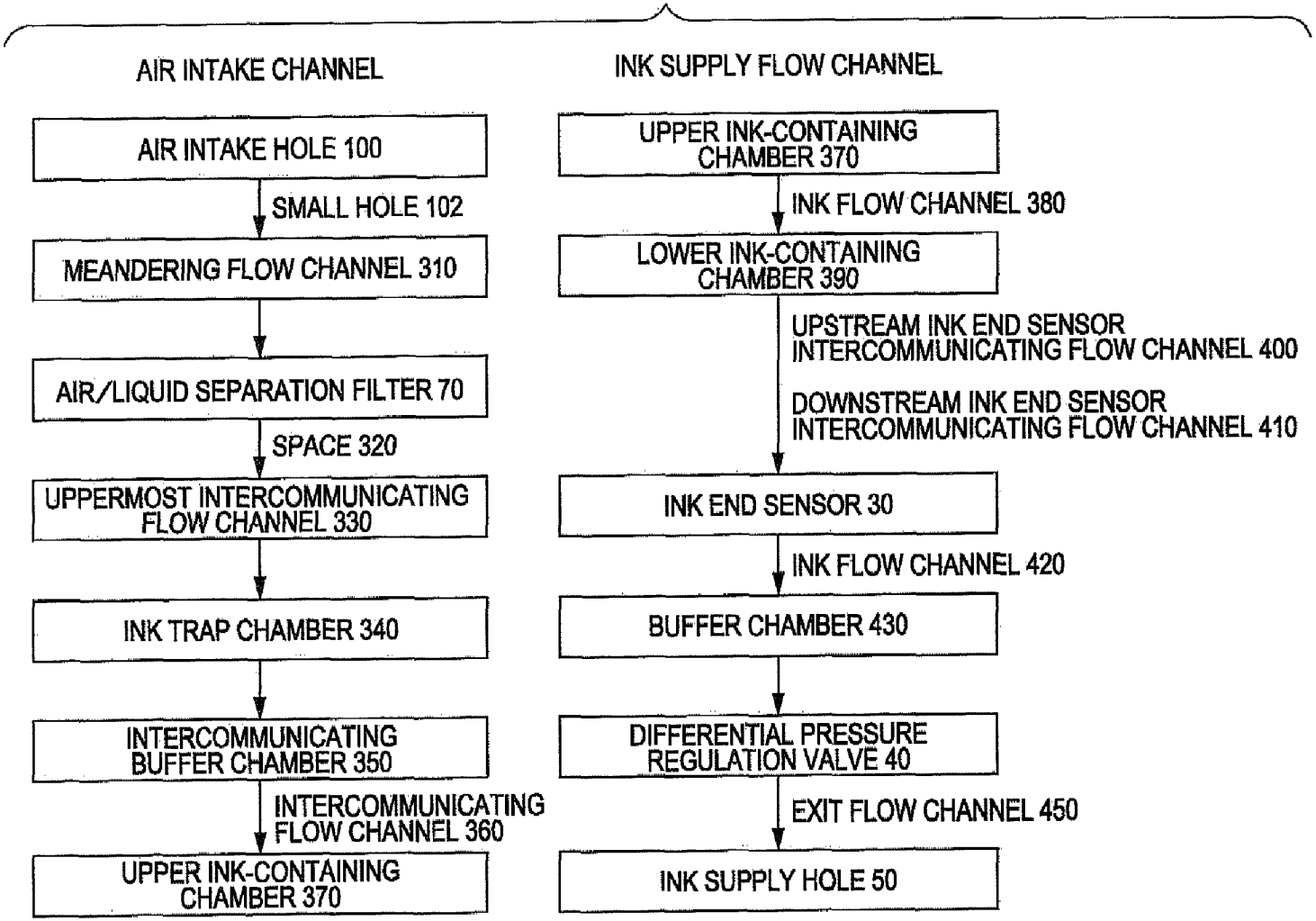
FIG. 12 is a conceptual diagram that explains the route structure of the fluid channels illustrated in FIG. 8.

FIG. 8 is a front view of the cartridge body 10 of the ink cartridge 1 according to the present embodiment of the invention. FIG. 9 is a rear view of the cartridge body 10 of the ink cartridge 1 according to the present embodiment of the invention. FIG. 10A is a simplified diagram that corresponds to FIG. 8, whereas FIG. 10B is a simplified diagram that corresponds to FIG. 9. FIG. 11 is a sectional view taken along the line A-A' of FIG. 8. FIG. 12 is a conceptual diagram that explains the route structure of the fluid channels formed in the cartridge body 10.

In the ink cartridge 1 according to the present embodiment of the invention, an upper ink-containing chamber (i.e., upstream ink-containing chamber) 370, a lower ink-containing chamber (i.e., downstream ink-containing chamber) 390, and a buffer chamber 430 are formed at the front side of the cartridge body 10. The upper ink-containing chamber 370 and the lower ink-containing chamber 390 constitute two main ink-containing chambers separated from each other. As illustrated in FIG. 10B, the air intake channel 150 through which air taken in from the outside flows to reach the upper ink-containing chamber 370, which is the most upstream ink-containing chamber, in accordance with the amount of ink consumed is provided at the rear side of the cartridge body 10. The upper ink-containing chamber 370, the lower ink-containing chamber 390, and the buffer chamber 430 are partitioned from one another by the ribs 10*a*. The ink flow channel 380 formed at the rear side of the cartridge body 10 communicates the upper ink-containing chamber 370 with the lower ink-containing chamber 390 via through holes that penetrate through the cartridge body 10 in its thickness direction. Similarly, the ink flow channel 420 formed at the rear side of the cartridge body 10 communicates the lower ink-containing chamber 390 with the buffer chamber 430 via through holes that penetrate through the cartridge body 10 in its thickness direction. With such a configuration, ink flows freely from the upstream chamber to the downstream chamber via the ink flow channels 380 and 420.

First of all, with reference to FIGS. 8-12, the ink flow channel that leads from the upper ink-containing chamber 370, which is a main ink-containing chamber, to the ink supply hole 50 is explained below.

The upper ink-containing chamber 370, which is the most upstream ink-containing chamber of the cartridge body 10, is formed at the front side of the cartridge body 10 as illustrated in FIG. 8. The upper ink-containing chamber 370 is an ink containing region/room that occupies approximately one half of the entire space of all ink-containing chambers. The upper ink-containing chamber 370 is formed approximately above the center of the cartridge body 10. A through hole 371 via which the upper ink-containing chamber 370 is in communication with the ink flow channel 380 is formed in the upper ink-containing chamber 370. The through hole 371 is formed at a position close to the lowest (i.e., bottom) part of the upper ink-containing chamber 370 that is partitioned by the ribs 10*a*. With such a configuration, the surface level of remaining ink is still above the through hole 371 even when the amount of ink remaining in the upper ink-containing chamber 370 is small.

As illustrated in FIG. 9, the ink flow channel 380, which is formed at the rear side of the cartridge body 10, is designed to guide ink from the upstream upper ink-containing chamber 370 to the downstream lower ink-containing chamber 390.

The lower ink-containing chamber 390 is an ink-containing room into which ink retained in the upper ink-containing chamber 370 flows. As illustrated in FIG. 8, the lower ink-containing chamber 390 is an ink-containing region that occupies approximately the other half of the entire space of all ink-containing chambers. The lower ink-containing chamber 390 is formed approximately below the center of the cartridge body 10. A through hole 391 via which the ink flow channel 380 is in communication with the lower ink-containing chamber 390 is formed in the lower ink-containing chamber 390.

The through hole 391 is formed at a position close to the lowest part of the lower ink-containing chamber 390 that is partitioned by the ribs 10*a*.

The lower ink-containing chamber 390 is in communication with an upstream ink end sensor intercommunicating flow channel 400 via another through hole that is not shown in the drawing. The upstream ink end sensor intercommunicating flow channel 400 has a three-dimensional intertwist flow channel. The intertwist structure of the upstream ink end sensor intercommunicating flow channel 400 is designed to trap any air bubbles or the like that has formed before reaching the ink end sensor. Thus, such air bubbles never flow to the downstream side of the upstream ink end sensor intercommunicating flow channel 400.

The upstream ink end sensor intercommunicating flow channel 400 is in communication with the downstream ink end sensor intercommunicating flow channel 410 via still another through hole that is not shown in the drawing. Ink flows through the downstream ink end sensor intercommunicating flow channel 410 into the ink remaining amount detection sensor 31.

The ink that has flown into the ink remaining amount detection sensor 31 passes through a cavity, which is a flow channel, of the ink remaining amount detection sensor 31 to be guided into the ink flow channel 420, which is formed at the rear side of the cartridge body 10. The ink flow channel 420 is configured to guide ink from the ink remaining amount detection sensor 31 in an inclined upward direction. A through hole 431 via which the ink flow channel 420 is in communication with the buffer chamber 430 is formed at the downstream end of the ink flow channel 420. With such a structure, the ink that has flowed out of the ink remaining amount detection sensor 31 passes through the ink flow channel 420 to enter the buffer chamber 430.

The buffer chamber 430 is a small room that is demarcated between the upper ink-containing chamber 370 and the lower ink-containing chamber 390 by the ribs 10*a*. The buffer chamber 430 functions as an ink reservation space that is provided at a position immediately before entering the differential pressure regulation valve 40. The buffer chamber 430 is formed at the rear side of the differential pressure regulation valve 40. The ink flows from the buffer chamber 430 into the differential pressure regulation valve 40 via a through hole 432.

The ink that has flown into the differential pressure regulation valve 40 is guided to the downstream side thereof by the differential pressure regulation valve 40 to flow into an exit flow channel 450 via a through hole 451. The exit flow channel 450 leads to the ink supply hole 50. The ink flows through the ink supply needle 240, which is inserted into the ink supply hole 50, to be supplied to the ink-jet recording apparatus.

Next, with reference to FIGS. 8-12 again, the air intake channel 150 that leads from the air intake hole 100 to the upper ink-containing chamber 370 is explained below.

As ink retained in the ink cartridge 1 is consumed to reduce the inner pressure of the ink cartridge 1, the outside air enters from the air intake hole 100 to flow into the upper ink-containing chamber 370 as much as the amount of ink consumed.

The small hole 102 formed inside the air intake hole 100 leads to one end of a meandering flow channel 310 that is formed at the rear side of the cartridge body 10. The meandering flow channel 310, which is a narrow and long fluid passage, is configured to have a long distance from the air intake hole 100 to the upper ink-containing chamber 370 so as to effectively suppress any undesirable evaporation of the moisture in ink. The other end of the meandering flow channel 310 leads to the air/liquid separation filter 70.

A through hole 322 is formed in the dented surface of the air/liquid separation chamber 70*a*, which constitutes a part of the air/liquid separation filter 70. Via the through hole 322, the air/liquid separation filter 70 is in communication with a space 320 that is formed at the front side of the cartridge body 10. In the air/liquid separation filter 70, the air/liquid separation film 71 is provided between the through hole 322 and the other end of the meandering flow channel 310. The air/liquid separation filter 70 is a woven mesh textile material featuring high liquid-repellent/oil-repellent characteristics.

The space 320 is provided at the upper right area adjacent to the upper ink-containing chamber 370 when viewed from the front side of the cartridge body 10. The space has another through hole 321 above the through hole 322. Via the through hole 321, the space 320 is in communication with an uppermost intercommunicating flow channel 330 that is formed at the rear side of the cartridge body 10.

The uppermost intercommunicating flow channel 330 is configured to pass the uppermost portion of the ink cartridge 1 attached to the ink-jet recording apparatus, which is defined as "uppermost" along the direction in which gravitational force works. The uppermost intercommunicating flow channel 330 is made up of a flow channel portion 333, a turn-around portion 335, and a flow channel portion 337. The flow channel portion 333 extends from the through hole 321 to the right along a long edge of the cartridge body 10 when viewed from the rear side thereof. After passing through the turn-around portion 335, which is formed in the proximity of a short edge thereof, air flows through the flow channel portion 337 which is formed above the flow channel portion 333 to reach a through hole 341, which is provided in the proximity of the through hole 321. The through hole 341 leads to an ink trap chamber 340 that is formed at the front side of the cartridge body 10.

While taking another look at the uppermost intercommunicating flow channel 330 from the rear side of the cartridge body 10, a further explanation of the features thereof is given below. The flow channel portion 337 of the uppermost intercommunicating flow channel 330 that extends from the turn-around portion 335 to the through hole 341 has an area 336 at which the through hole 341 is formed and a concave portion 332 which has a relatively large depth in the thickness direction of the cartridge body 10 in comparison with the area 336. A plurality of ribs 331 is formed so as to partition the concave portion 332. In addition, the flow channel portion 333 thereof that extends from the through hole 321 to the turn-around portion 335 has a relatively small depth in comparison with the flow channel portion 337 thereof that extends from the turn-around portion 335 to the through hole 341.

In this exemplary embodiment of the invention, as has already been described above, the uppermost intercommunicating flow channel 330 is configured to pass the uppermost portion of the ink cartridge 1, viewed along the direction in which gravitational force works. For this reason, under normal use conditions, it is designed so that ink should never move against gravitational force to flow beyond the uppermost intercommunicating flow channel 330 toward the air intake hole 100. In addition, the uppermost intercommunicating flow channel 330 is designed to have a diameter that is large enough to effectively prevent the backflow of ink due to a capillary phenomenon or the like. Moreover, since the concave portion 332 is provided in the flow channel portion 337, it is designed to easily trap any ink that has flowed back to enter the concave portion 332.

The ink trap chamber 340 is a space having the shape of a rectangular parallelepiped. The ink trap chamber 340 is formed at the upper right corner of the cartridge body 10 when viewed from the front side thereof. As illustrated in FIG. 10A, the through hole 341 is formed in the proximity of the upper left distal corner of the ink trap chamber 340. A notch portion 342, which is formed by cutting out a part of the partition rib 10*a*, is formed on the lower right proximal corner of the ink trap chamber 340. The ink trap chamber 340 is in communication with an intercommunicating buffer chamber 350 through the notch portion 342. The ink trap chamber 340 and the intercommunicating buffer chamber 350 are air chambers each of which is formed by enlarging the dimension (i.e., capacity) of a certain halfway point en route on the air intake channel 150. The ink trap chamber 340 and the intercommunicating buffer chamber 350 are designed to trap, if any, ink that has flowed back from the upper ink-containing chamber 370 due to some reason so as to prevent such a back-flowed ink from going beyond the ink trap chamber 340 and the intercommunicating buffer chamber 350 toward the air intake hole 100.

The intercommunicating buffer chamber 350 is a space formed below the ink trap chamber 340. The pressure reduction hole 110, which is provided for vacuuming at the time of filling of ink, is formed on the bottom surface 352 of the intercommunicating buffer chamber 350. A through hole 351 is formed in the proximity of the bottom surface 352 in the thickness direction of the cartridge body 10. The position at which the through hole 351 is formed lies in the lowermost portion of the ink cartridge 1 attached to the ink-jet recording apparatus, which is defined as "lowermost" along the direction in which gravitational force works. The intercommunicating buffer chamber 350 is in communication with an intercommunicating flow channel 360 via the through hole 351.

The intercommunicating flow channel 360 extends toward the center of the cartridge body 10 in an upward direction when viewed from the rear side thereof. The intercommunicating flow channel 360 is in communication with the upper ink-containing chamber 370 via a through hole 372, which is formed in the proximity of the bottom surface of the upper ink-containing chamber 370. That is, an air passage leading from the air intake hole 100 to the intercommunicating flow channel 360 constitutes the air intake channel 150 according to the present embodiment of the invention.

As illustrated in FIG. 8, in the ink cartridge 1 according to the present embodiment of the invention, an empty chamber 501 in which no ink is filled is formed at the front side of the cartridge body 10 in addition to the aforementioned ink-containing chambers (upper ink-containing chamber 370, lower ink-containing chamber 390, and buffer chamber 430), air chambers (ink trap chamber 340 and intercommunicating buffer chamber 350), and ink flow channels (upstream ink end sensor intercommunicating flow channel 400 and downstream ink end sensor intercommunicating flow channel 410).

The empty chamber 501, which is shown as a hatched area close to the left edge of the cartridge body 10 in the drawing, is demarcated between the upper ink-containing chamber 370 and the lower ink-containing chamber 390 at the front side thereof. An air hole 502 that penetrates the cartridge body 10 to the rear side thereof is provided at the upper left corner of the inner region of the empty chamber 501. The air hole 502 leads to the outside thereof. When the ink cartridge 1 is subjected to vacuum packing, the empty chamber 501 becomes a deaeration chamber that contains/accumulates negative pressure for deaeration.

In the ink cartridge 1 having a configuration described above, even in a case where small air bubbles has formed in the cavity of the ink remaining amount detection sensor 31 during an ink-filling step of ink-cartridge production at a factory, such small air bubbles remaining in the cavity of the ink remaining amount detection sensor 31 dissolve into ink and thus disappear thanks to the action of deaeration negative pressure that expels any remaining air out of the ink cartridge 1 when the ink cartridge 1 is subjected to vacuum packing. Moreover, deaeration negative pressure applied at the time of vacuum packing is contained/accumulated in the no-ink-filled chamber (i.e., empty chamber) 501 in such a manner that the no-ink-filled chamber 501 of the cartridge body 10 functions as a pressure reduction space (i.e., deaeration chamber) that causes any air bubbles remaining in the cartridge body 10 to be dissolved to disappear effectively up to the time when a user opens the package of the ink cartridge 1. Therefore, the invention provides the ink cartridge 1 that is capable of removing air bubbles that remain in the ink remaining amount detection sensor 31 with a greater certainty, thereby making it possible to prevent the ink remaining amount detection sensor 31 from performing erroneous detection attributable to the remaining air bubbles.

Furthermore, the ink cartridge 1 according to the present embodiment of the invention is provided with the ink trap chamber 340 and the intercommunicating buffer chamber 350 that are configured as air chambers each of which is formed by enlarging the dimension of a certain halfway point en route on the air intake channel 150 through which air that has been taken in from the outside flows to reach the upper ink-containing chamber 370 in accordance with the amount of ink consumed. Therefore, when any ink retained in the upper ink-containing chamber 370 flows back through the air intake channel 150 during use of the ink cartridge 1 due to thermal expansion, external vibration, or any other reason, it is possible to prevent the back-flowed ink from leaking out because the ink trap chamber 340 and the intercommunicating buffer chamber 350 that are provided as air chambers en route on the air intake channel 150 function as ink-trap spaces so as not to pass the back-flowed ink therethrough.

Still moreover, in a vacuum-packed state, the ink cartridge 1 according to the present embodiment of the invention is provided with the sealing film 90 that functions as a stopper to block the air intake channel 150 at an upstream position more closer to the air intake hole in comparison with the ink trap chamber 340 and the intercommunicating buffer chamber 350 that are configured as air chambers. Therefore, it is possible to ensure that ink does not leak out of the air intake hole in a vacuum-packed state.

Figure 13:
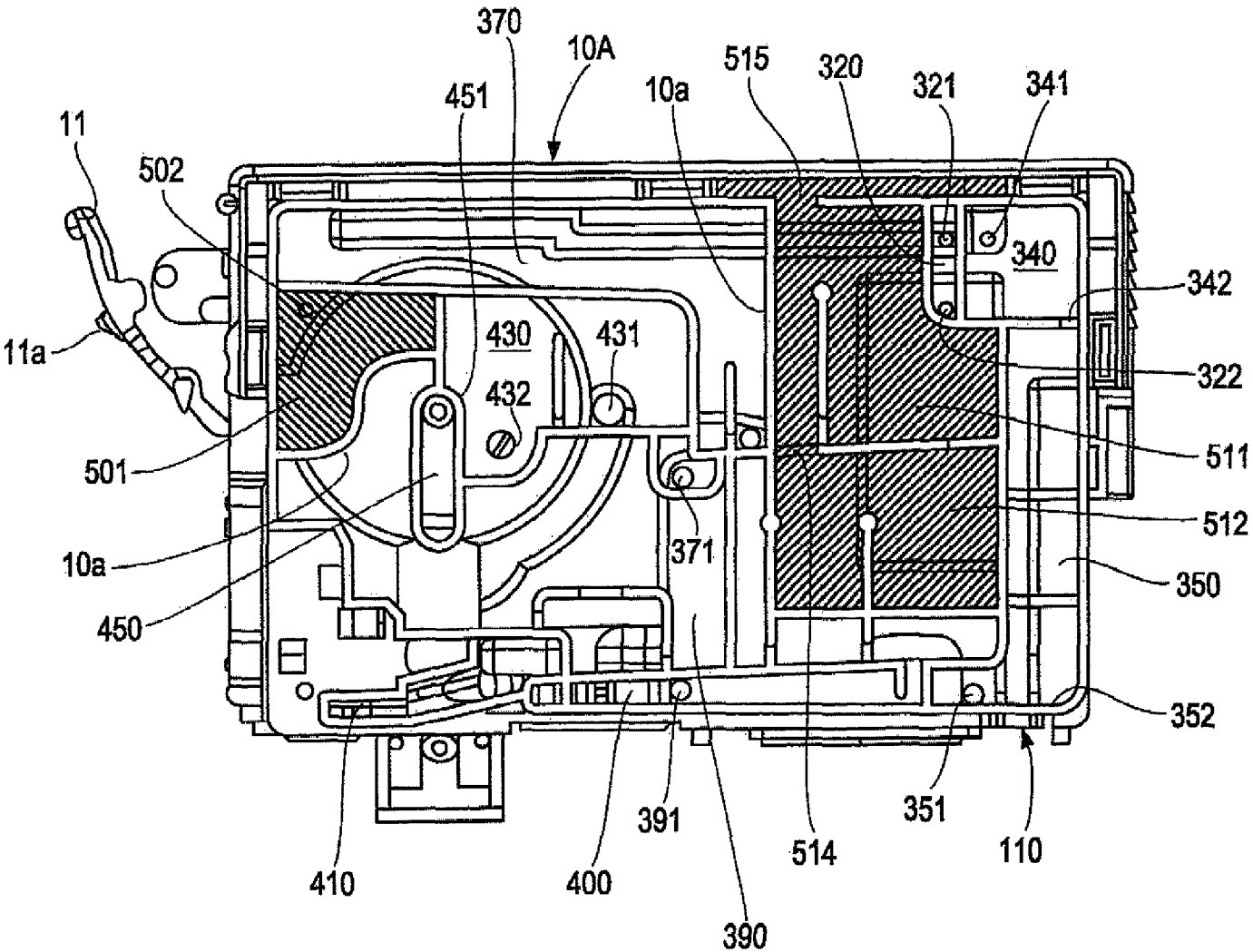
FIG. 13 is a front view of the ink cartridge according to the second embodiment of the invention.

It should be noted that the position at which the no-ink-filled chamber according to the invention is provided, the dimension thereof, and the number thereof are not limited to the specific example described in the above exemplary embodiment. FIG. 13 is a front view of the cartridge body 10A of an ink cartridge that is an example of a liquid container having no-ink-filled chambers according to a second embodiment of the invention. Compared with the cartridge body 10 according to the first embodiment of the invention, the cartridge body 10A according to the second embodiment of the invention is provided with the upper ink-containing chamber 370 and lower ink-containing chamber 390 having a smaller dimension in comparison therewith so as to accommodate two additional no-ink-filled chambers 511 and 512, which are demarcated between the ink-containing chambers (upper ink-containing chamber 370 and lower ink-containing chamber 390) and the air chambers (ink trap chamber 340 and intercommunicating buffer chamber 350) provided at the right edge portion of the cartridge body 10A.

Except for the additional components of the no-ink-filled chambers 511 and 512, the configuration of the cartridge body 10A according to the second embodiment of the invention is the same as that of the cartridge body 10 according to the first embodiment of the invention. Therefore, in the following description, the same reference numerals are consistently used for the same components as those of the cartridge body 10 according to the first embodiment to omit any redundant explanation thereof.

These two no-ink-filled chambers 511 and 512 are vertically arranged adjacent to each other. The upper no-ink-filled chamber 511 is formed between the upper ink-containing chamber 370 and the ink trap chamber 340 by reducing the horizontal size of the upper ink-containing chamber 370. On the other hand, the lower no-ink-filled chamber 512 is formed between the lower ink-containing chamber 390 and the intercommunicating buffer chamber 350 by reducing the horizontal size of the lower ink-containing chamber 390.

These two no-ink-filled chambers 511 and 512 are in communication with each other via a notch portion 514 formed by cutting out a part of the partition rib 10*a* therebetween. Another notch portion 515 is formed by cutting out a part of the upper-edge partition rib 10*b* of the upper no-ink-filled chamber 511. Via the notch portion 515, the upper no-ink-filled chamber 511 is in communication with the outside (air) of the cartridge body 10A. This further means that the lower no-ink-filled chamber 512 is also in communication with the outside of the cartridge body 10A via the upper no-ink-filled chamber 511.

Likewise the no-ink-filled chamber (i.e., empty chamber) 501 according to the first embodiment of the invention, these two no-ink-filled chambers 511 and 512 become deaeration chambers that contain/accumulate negative pressure for deaeration when the ink cartridge is subjected to vacuum packing.

With the addition of the no-ink-filled chambers 511 and 512, according to the present embodiment of the invention, no-ink-filled chambers that become deaeration chambers when the ink cartridge is subjected to vacuum packing are formed at a plurality of positions in the cartridge body 10A in a distributed layout.

In addition, these additional no-ink-filled chambers 511 and 512 are arranged adjacent to the upper ink-containing chamber 370, the lower ink-containing chamber 390, the ink trap chamber 340, and the intercommunicating buffer chamber 350. The total sum of the dimension of the no-ink-filled chambers 501, 511, and 512 is configured to be larger than the sum of that of the ink trap chamber 340 and the intercommunicating buffer chamber 350 that constitute air chambers.

In the ink cartridge according to the second embodiment of the invention described above, the pressure-reducing action of deaeration negative pressure that is contained/accumulated in each of the no-ink-filled chambers 501, 511, and 512 works at the plurality of positions in the cartridge 10A. This ensures, advantageously, that the pressure-reducing action of deaeration negative pressure, which is effective for removing air bubbles, works in a wider area of the cartridge body 10 in a more uniform manner. In addition, such pressure-reducing action works multi-directionally (i.e., from a relatively large number of directions) on the position at which air bubbles have formed. For these reasons, the ink cartridge according to the second embodiment of the invention makes it possible to remove air bubbles with a greater efficiency than the ink cartridge according to the first embodiment of the invention.

In an ink cartridge having air chambers such as the ink trap chamber 340 and the intercommunicating buffer chamber 350, generally speaking, a higher deaeration performance is required for removing air bubbles because the amount of air remaining in the cartridge body increases by the dimension of the ink trap chamber 340 and the intercommunicating buffer chamber 350. In this respect, since the total sum of the dimension of the no-ink-filled chambers 501, 511, and 512 is configured to be larger than the sum of that of the ink trap chamber 340 and the intercommunicating buffer chamber 350 that constitute air chambers, the ink cartridge according to the present embodiment of the invention makes it possible to easily maintain high deaeration performance. With an assured high deaeration performance, the invention makes it possible to remove air bubbles that remain in the ink remaining amount detection sensor 31 with a greater reliability.

In addition, in the ink cartridge according to the present embodiment of the invention, the no-ink-filled chambers 511 and 512 adjoin the upper/lower ink-containing chambers 370 and 390 with a partition wall interposed therebetween in such a manner that each of them has a wide adjoining area. Similarly, the no-ink-filled chambers 511 and 512 further adjoin the ink trap chamber 340 and the intercommunicating buffer chamber 350 with a partition wall interposed therebetween in such a manner that each of them has a wide adjoining area. Having such a structure, the ink cartridge according to the present embodiment of the invention makes it possible to improve the deaeration efficiency inside the cartridge body 10A so as to remove air bubbles that remain in the ink remaining amount detection sensor 31 with a greater reliability. Thus, the ink cartridge according to the present embodiment of the invention makes it possible to prevent the ink remaining amount detection sensor 31 from performing erroneous detection that could be caused by the remaining air bubbles.

Figure 14:
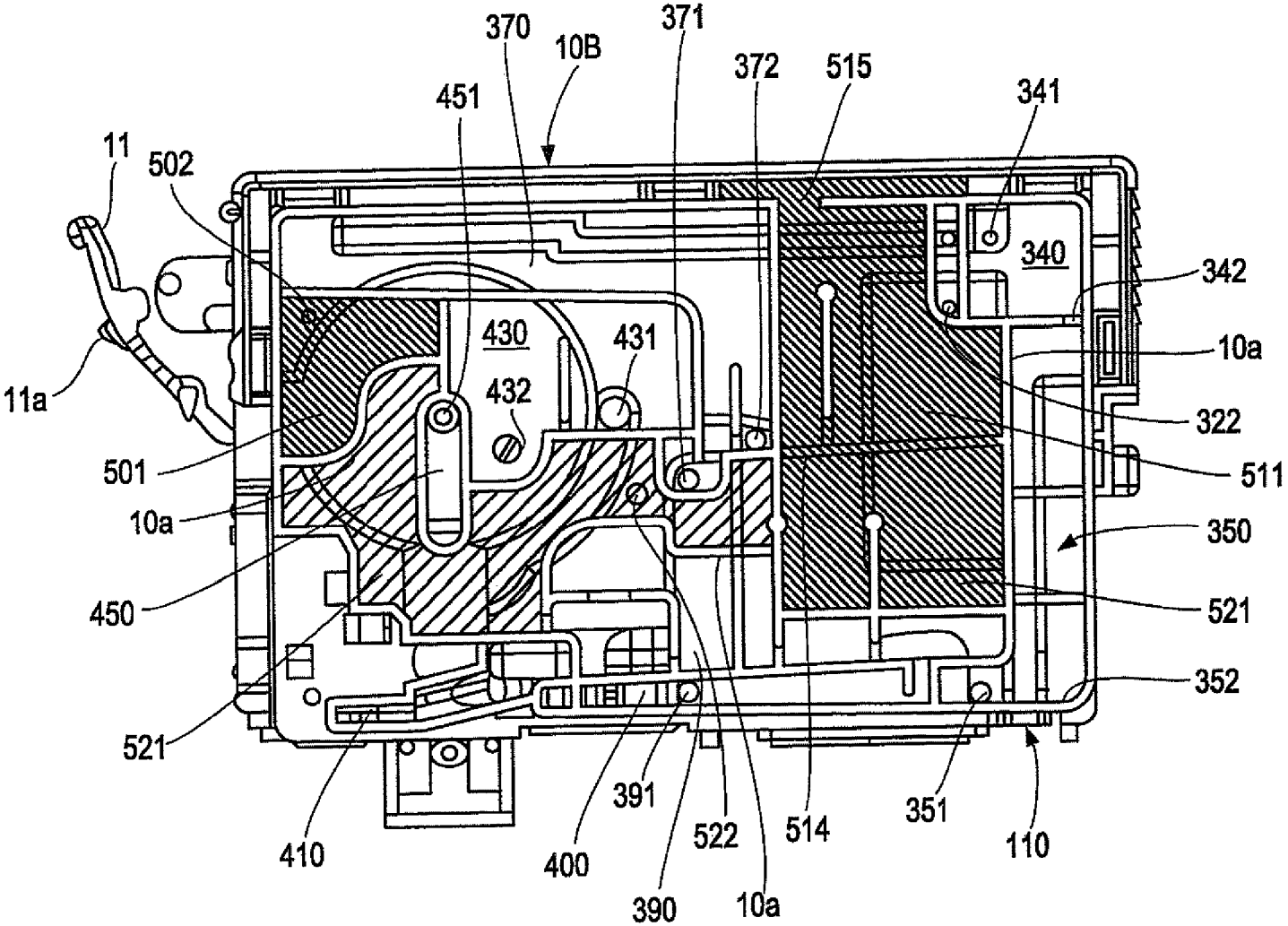
FIG. 14 is a front view of the ink cartridge according to the third embodiment of the invention.
Figure 15:
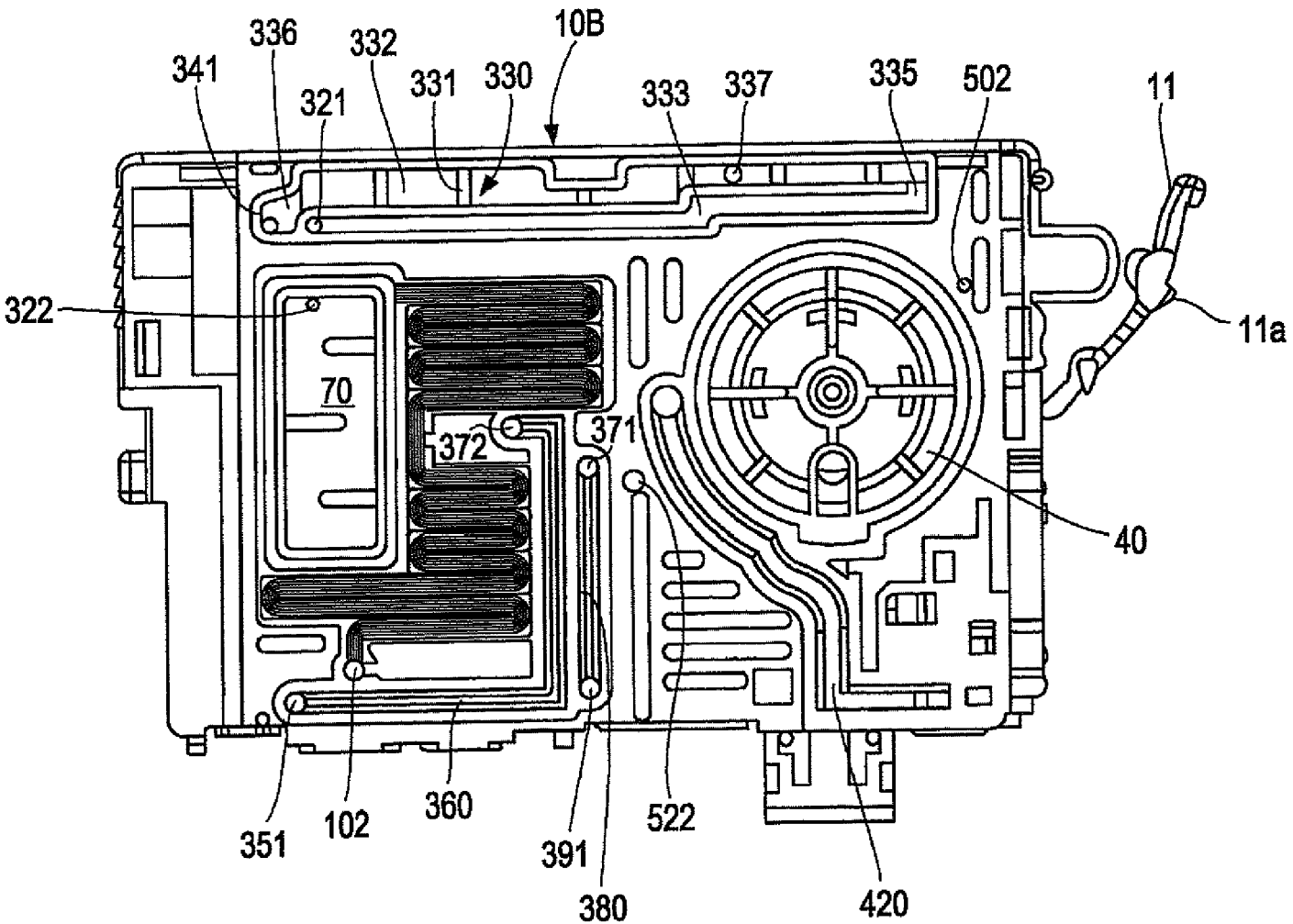
FIG. 15 is a rear view of the ink cartridge illustrated in FIG. 14.

FIG. 14 is a front view of the cartridge body 10B of an ink cartridge that is an example of a liquid container having no-ink-filled chambers according to a third embodiment of the invention. FIG. 15 is a rear view of the cartridge body 10B of the ink cartridge that is an example of a liquid container having no-ink-filled chambers according to the third embodiment of the invention. In comparison with the cartridge body 10A according to the second embodiment of the invention, the cartridge body 10B according to the third embodiment of the invention has a further additional no-ink-filled chamber 521, which is demarcated between the buffer chamber 430 and the lower ink-containing chamber 390 at a space vacated by reducing the size of the lower ink-containing chamber 390.

Except for the additional component of the no-ink-filled chamber 521, the configuration of the cartridge body 10B according to the third embodiment of the invention is the same as that of the cartridge body 10A according to the second embodiment of the invention. Therefore, in the following description, the same reference numerals are consistently used for the same components as those of the cartridge body 10A according to the second embodiment to omit any redundant explanation thereof.

The no-ink-filled chamber 521 adjoins the lower ink-containing chamber 390, which are formed in the proximity of the cavity of the ink remaining amount detection sensor 31, and the upstream ink end sensor intercommunicating flow channel 400 and downstream ink end sensor intercommunicating flow channel 410. An air hole 522, which penetrates the cartridge body 10 to the rear side thereof, is formed in the neighborhood of the approximately central position of the cartridge body 10B. The no-ink-filled chamber 521 is in communication with the outside of the cartridge body 10B via the air hole 522. Similar to other no-ink-filled chambers, the empty chamber 521 has no ink filled therein. When the ink cartridge is subjected to vacuum packing, the no-ink-filled chamber 521 becomes a deaeration chamber that contains/accumulates negative pressure for deaeration.

In the ink cartridge according to the present embodiment of the invention, with the addition of the no-ink-filled chamber 521, the total sum of dimension of all of the no-ink-filled chambers is designed to be larger than that of all of the ink-containing chambers (that is, the aggregate dimension of the upper ink-containing chamber 370, lower ink-containing chamber 390, and buffer chamber 430).

When the total sum of dimension of the no-ink-filled chambers is larger than that of the ink-containing chambers, a comparatively large amount of negative pressure for deaeration is contained/accumulated in the no-ink-filled chambers 501, 511, 512, and 521. This makes it possible to maintain an ink cartridge contained in a vacuum-packed package in a good pressure-reduced environment until a user opens the package thereof, thereby making it possible to prolong the efficacy of reduced pressure in removing air bubbles in the vacuum-packed ink cartridge for a long time. Thus, with the configuration of the ink cartridge according to the present embodiment of the invention, it is possible to further improve the shelf life of a vacuum-packed ink cartridge. In particular, since the no-ink-filled chamber 521 is formed adjacent to the ink-containing region in the proximity of the cavity of the ink remaining amount detection sensor 31, it is possible to remove air bubbles that remain in the cavity of the ink remaining amount detection sensor 31 in a greater reliability. Moreover, with the addition of the no-ink-filled chamber 521, the ink cartridge is configured such that a greater number of the no-ink-filled chambers are formed inside the cartridge body thereof in a distributed layout. With such a structure, it is possible to further enhance the advantageous effects of the distributed arrangement of empty chambers (that is, more uniform pressure-reducing action that works on the entire region of the ink cartridge).

It should be noted that the application/use of a liquid container according to the present invention is not limited to an ink cartridge that is described in the above exemplary embodiments of the invention. It should be further noted that the application/use of a liquid consumption apparatus that is provided with a container attachment unit to which a liquid container according to the present invention is detachably attached is not limited to an ink-jet recording apparatus that is described in the above exemplary embodiments of the invention. In addition to an ink-jet recording apparatus described in the exemplary embodiments above, a liquid consumption apparatus to which the invention is applicable encompasses a wide variety of other types of apparatuses such as one that is provided with a container attachment unit to which a liquid container is detachably attachable so as to supply liquid retained therein to the apparatus. Examples of a liquid consumption apparatus according to the invention include, without any limitation thereto: an apparatus that is provided with a color material ejection head that is used in the production of color filters for a liquid crystal display device or the like; an apparatus that is provided with an electrode material (i.e., conductive paste) ejection head that is used for electrode formation for an organic EL display device, a surface/plane emission display device (FED), and the like; an apparatus that is provided with a living organic material ejection head used for production of biochips; and an apparatus that is provided with a sample ejection head functioning as a high precision pipette.

What is claimed is:

1. A liquid container having a container body that can be detachably attached to a liquid consumption apparatus, the container body of the liquid container comprising:

a liquid containing chamber that retains liquid;

a liquid supply hole that is provided to supply the liquid retained in the liquid containing chamber to the liquid consumption apparatus;

a liquid flow channel through which the liquid containing chamber is in communication with the liquid supply hole;

a liquid remaining amount detection sensor having a cavity that constitutes a part of the liquid flow channel, a diaphragm that constitutes a part of a wall surface of the cavity, and a piezoelectric element that applies a vibration to the diaphragm, the liquid remaining amount detection sensor detecting the presence or absence of liquid in the liquid flow channel on the basis of residual vibration in response to the vibration applied to the diaphragm; and a no-liquid-filled empty chamber that is in communication with the outside of the container body, the empty chamber with no liquid filled therein becoming a deaeration chamber that contains and/or accumulates negative pressure for deaeration when the liquid container is subjected to vacuum packing.

2. The liquid container according to claim 1, wherein the empty chamber having no liquid filled therein has a dimension larger than the liquid containing chamber.

3. The liquid container according to claim 1, wherein the empty chamber having no liquid filled therein is formed at a plurality of positions in the container body in a distributed layout.

4. The liquid container according to claim 1, further comprising:

an air intake channel through which air that has been taken in from the outside flows to reach the liquid containing chamber in accordance with the consumption amount of the liquid retained in the liquid containing chamber;

an air chamber that is formed by enlarging the dimension of a certain halfway point en route on the air intake channel; and a stopper that blocks, in a vacuum-packed state, the air intake channel at a relatively upstream position in comparison with the air chamber.

5. The liquid container according to claim 4, wherein the empty chamber having no liquid filled therein has a dimension larger than the air chamber.

6. The liquid container according to claim 4, wherein the empty chamber having no liquid filled therein is formed adjacent to the liquid containing chamber and the air chamber.

7. The liquid container according to claim 1, wherein the empty chamber having no liquid filled therein is formed adjacent to the liquid containing chamber that is formed in the proximity of the cavity of the liquid remaining amount detection sensor.

* * * * *